United States Patent [19]

Jensen et al.

[11] Patent Number: 4,627,792

[45] Date of Patent: Dec. 9, 1986

[54] ROTATING FLOW PUMP WITH A FEED PUMP UNIT FORMED AS AN EJECTOR

[75] Inventors: Niels D. Jensen; Gunnar Langgaard, both of Bjerringbro, Denmark

[73] Assignee: Grundfos A/S, Bjerringbro, Denmark

[21] Appl. No.: 775,160

[22] Filed: Sep. 12, 1985

[51] Int. Cl.[4] ..... F04B 23/14

[52] U.S. Cl. ..... 417/83; 417/89

[58] Field of Search ..... 417/76, 79–84, 417/87–89

[56] References Cited

U.S. PATENT DOCUMENTS

| | | | |
|---|---|---|---|
| 2,203,077 | 6/1940 | Carpenter | 417/83 |
| 2,474,539 | 6/1949 | Mann | 417/201 X |
| 2,478,941 | 8/1949 | Piccardo | 417/81 |
| 2,578,322 | 12/1951 | Shallenberg | 417/83 |
| 2,845,028 | 7/1958 | Nash et al. | 417/81 |
| 3,185,101 | 5/1965 | Brooks et al. | 415/176 |
| 3,817,659 | 6/1974 | Erickson et al. | 417/89 X |
| 3,894,813 | 7/1975 | Cooper | 417/89 X |

FOREIGN PATENT DOCUMENTS

| | | | |
|---|---|---|---|
| 2411572 | 10/1974 | Fed. Rep. of Germany | 417/84 |

*Primary Examiner*—William L. Freeh
*Assistant Examiner*—Paul F. Neils
*Attorney, Agent, or Firm*—Michael N. Meller

[57] ABSTRACT

A rotating flow pump such as a centrifugal pump is provided with a feed pump unit formed as an ejector. The feed pump unit comprises an inlet portion, a nozzle, and a diffuser arranged in succession, and the diffuser is connected to the inlet opening of the flow pump. The inlet portion, the nozzle, and the diffuser of the ejector are situated in a plane perpendicular to the shaft of the flow pump. The diffuser comprises an inner channel of a uniformly increasing flow cross section at least over part of its length. Furthermore the diffuser comprises an outer jacket situated substantially coaxially about the above channel. Thus the jacket is formed in such a manner that a substantially 180° almost mushroom-shaped turning of the flow direction for the liquid flowing through the diffuser is obtained at the same time as a uniformly increasing flow cross section—seen in the flow direction—is obtained within the annular chamber between the channel and the jacket. In this manner the diffusing capacity of the ejector can be very high at the same time as the flow pump takes up relatively little room.

10 Claims, 2 Drawing Figures

ROTATING FLOW PUMP WITH A FEED PUMP UNIT FORMED AS AN EJECTOR

FIELD OF THE INVENTION

The invention relates to a rotating flow pump such as a centrifugal pump and comprising a feed pump unit formed as an ejector with an inlet portion, a nozzle, and a diffuser arranged in succession, and whereby the diffuser is connected to the inlet opening of the flow pump.

BACKGROUND ART

A centrifugal pump provided with a feed pump unit formed as an ejector is known. Though the diffuser of the ejector has been bent 180° like a hairpin, the axial length of the centrifugal pump is relatively great because the longitudinal axis of the diffuser extends substantially parallel to the shaft of the centrifugal pump.

SUMMARY OF THE INVENTION

The object of the invention is to provide a rotating flow pump of the above type which allows a very high diffusion capacity of the ejector at the same time as the flow pump takes up relatively little room.

The rotating flow pump according to the invention is characterized in that the inlet portion, the nozzle, and the diffuser of the ejector are situated in a plane substantially perpendicular to the shaft of the flow pump, and that the diffuser comprises an inner channel means having a uniformly increasing flow cross section at least over part of its length, said diffuser furthermore comprising an outer jacket means situated substantially coaxially about the channel means and providing a substantially 180°, almost mushroom-shaped turning of the flow direction of the liquid flowing through the diffuser and furthermore providing a uniformly increasing flow cross section when seen in the flow direction within the annular chamber between the channel means and the jacket means. In this manner the axial length of the flow pump is smaller than usual because the diffuser so to speak has been "turned backwards on itself" and is connectable to the inlet opening of the flow pump without requiring much axial length. At the same time the diffusion capacity has been improved because the total length of the diffuser can be made relatively great.

According to the invention the channel means may be formed as an elongated tube and may be situated in such a manner that its longitudinal axis intersects the axis of the shaft of the flow pump, whereby a further improved diffusion capacity is obtained because the inner channel means can be made very long.

Furthermore, according to the invention the jacket means may be substantially tubular and comprise a bottom wall at one end, at least part of said bottom wall being rounded for a gradual turning of 180° of the flow of liquid, whereby a very simple structure is obtained.

Moreover, according to the invention the opposite end of the jacket means may be curved to form an outlet opening communicating with the inlet opening of the flow pump. In this manner the diffuser is particularly effective involving very poor losses.

According to the invention the inlet portion and the channel means may together be substantially U-shaped, whereby room is saved at the same time as the suction liquid can be reliably fed to the diffuser.

Moreover, according to the invention the nozzle may be mounted in a wall in the bottom of the U and coaxially with the channel means, whereby the access to and inspection of the nozzle are particularly easy.

According to the invention the nozzle may communicate with the pressure side of the flow pump through a chamber defined partly by a jacket surrounding the ejector and partly by a casing associated with the flow pump, whereby a very simple structure and a short axial length are obtained.

According to the invention the channel means may be secured to the jacket means by means of sealing contact surfaces on said channel means, and optionally by means of a fixing projection and the jacket. As a result a very reliable interconnection of the channel means and the jacket means is obtained. In addition the mounting procedure of the above two members is very simple.

Moreover, according to the invention the flow pump may comprise an outer pressure stub communicating with the pressure chamber behind the jacket, as well as an outer suction stub communicating with the inlet portion as it extends through the jacket, whereby an extremely simple structure is obtained.

Finally according to the invention at least part of the jacket means may be formed integral with the casing of the flow pump, especially a front wall therein, preferably through casting, whereby the axial length of the flow pump can be additionally reduced.

According to the invention part of the jacket means is preferably formed integral with the inner channel means.

BRIEF DESCRIPTION OF DRAWING

The invention will be described below with reference to the accompanying drawing, in which.

DESCRIPTION OF PREFERRED EMBODIMENTS

Figure 1:
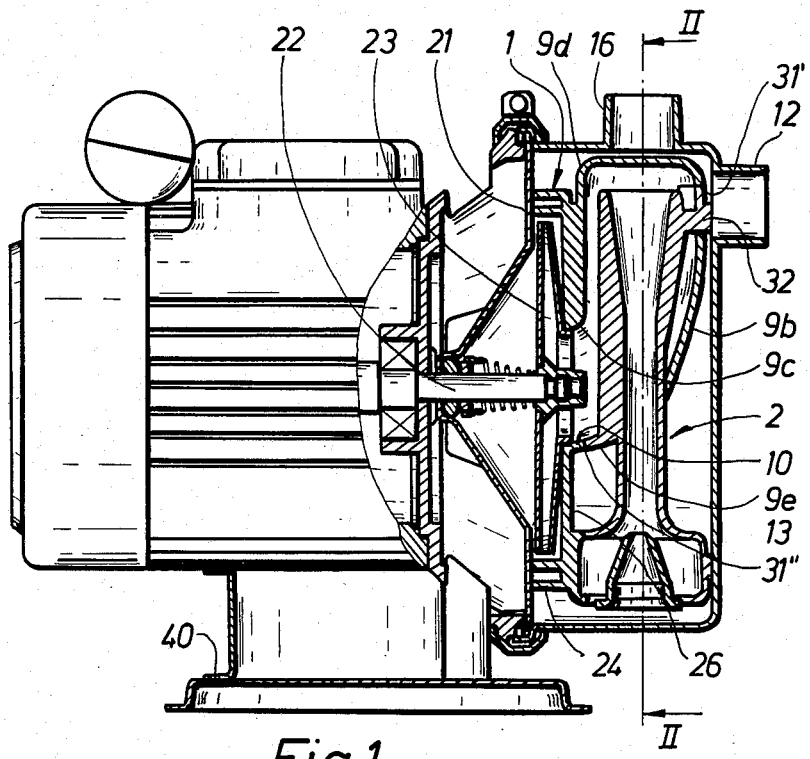
FIG. 1 is a longitudinal sectional view through a centrifugal pump with a feed pump unit in the form of an ejector, the nozzle and the diffuser of the ejector being turned into the vertical position for the sake of clarity.

The centrifugal pump 1 of FIG. 1 is provided with a feed pump unit in the form of an ejector 2. The latter comprises an inlet portion 5, a nozzle 6, and a diffuser 7, cf. FIG. 2, arranged in succession when seen in the flow direction of the pump medium. The diffuser 7 is connected to the inlet opening 10 of the centrifugal pump 1. The inlet portion is connected to an outer suction stub 12 secured in a jacket 13 surrounding the ejector, the jacket in turn being secured on part of a casing 21 associated with the centrifugal pump. The centrifugal pump comprises in conventional manner a pump shaft 22 and a rotor 23 arranged thereon. A guide device 24 surrounds the rotor 23. The pressure fluid produced by the centrifugal pump can pass into a chamber 15 defined by the jacket 13 and the centrifugal pump. The pressure fluid can continue from the chamber 15 through an outer pressure stub 16.

Figure 2:
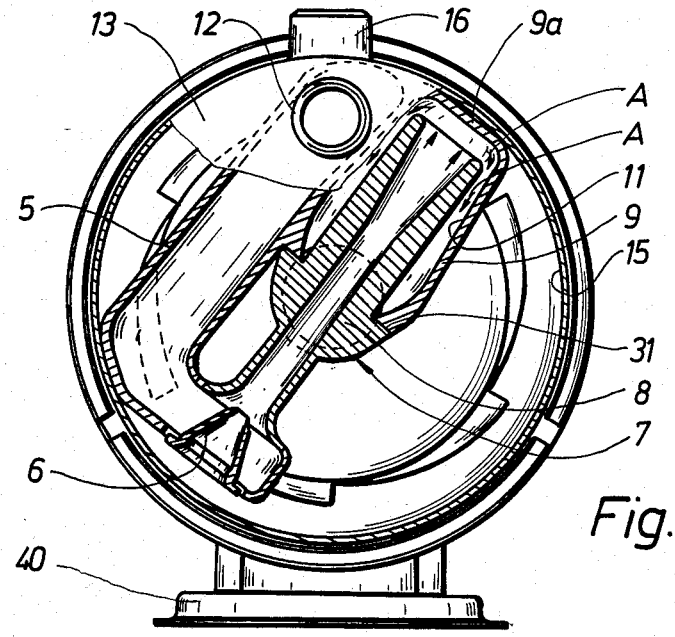
FIG. 2 is a sectional view of the embodiment of FIG. 1 taken along the line II—II of FIG. 1, the ejector being shown in its correct inclined position.

As illustrated in FIGS. 1 and 2 the inlet portion 5, the nozzle 6, and the diffuser 7 of the ejector are situated in a plane substantially perpendicular to the pump shaft 22. The diffuser 7 comprises a channel means 8 and a jacket means 9. As illustrated the channel means 8 can be formed by an elongated tube, the longitudinal axis of which intersects the longitudinal axis of the pump shaft 22. At least over part of its length—the last third of the tube length in FIG. 2—the channel means 8 has of a uniformly increasing flow cross section. The jacket means 9 is situated about and substantially coaxially with the channel means 8. The jacket means defines an annular chamber 11 about the channel means 8. As illustrated the jacket means 9 comprises a partly rounded bottom 9*a*, whereby the flow direction of the flow of liquid passing through the channel means 8 when the centrifugal pump is running is turned substantially 180° in an almost mushroom-shaped manner, cf. the small arrows A at the upper end of the channel means. It is noted that the flow cross section within the annular chamber 1 is uniformly increased in the flow direction. As shown, the jacket means 9 may be substantially tubular, but at the end 9*b* opposing the bottom wall 9*a* the jacket means is curved to form an outlet opening 9*c* communicating with the inlet opening 10 of the centrifugal pump. FIG. 1 clearly shows how at least part 9*d* of the jacket means 9 can be formed (cast) integral with a front wall 26 in the casing 21, the above guide device 24 forming an integrating part of said front wall. An important advantage of manufacturing the diffuser with a channel means and an outer jacket means is partly that admixing of air on the suction side of the centrifugal pump occurs easily when the pump has been started and partly that the axial length of the structure is somewhat reduced.

As illustrated in FIG. 2 the inlet portion 5 and the channel means together may form a U, and the nozzle 6 may be mounted in a wall in the bottom of said U and coaxially with the channel means 8.

Concerning feeding of pressure fluid to the ejector 6, it is noted that said feeding takes place from the chamber 15 inside the jacket 13.

A portion 9*e* of the jacket means 9 may be formed integral with the inner channel means 8 (see FIG. 1).

Concerning the securement of the channel means 8 to the jacket means 9, it is noted that this securement can be carried out by means of sealing circumferential contact surfaces 31 on the channel means, a fixing projection 32 as well as the jacket 13.

As illustrated in FIG. 1 the centrifugal pump is driven by an electric motor. It may, however, be driven in many other ways. The rotating flow pump according to the invention need not necessarily be a centrifugal pump either. It may, for instance be a mixed-flow pump.

The rotating flow pump is provided with a conventional base 40.

The invention may be varied in many ways without thereby deviating from the scope thereof.

What is claimed is:

1. In an arrangement of a centrifugal pump and a feed pump unit formed as an ejector, centrifugal pump comprising an impeller rotatably mounted on a substantially horizontal shaft in a chamber defined by a casing, said chamber communicating with an inlet, and said ejector comprising an inlet portion, a nozzle, and a diffuser arranged in series in the flow direction and in a plane substantially perpendicular to said shaft, said diffuser having a channel means defining an inner channel which gradually increases in cross-sectional area along at least a portion of its length and a jacket means defining an annular channel which surrounds and is substantially coaxial with said inner channel, said inner channel having an outlet which communicates with a reversal chamber defined by an end wall of said jacket means, said reversal chamber further communicating with said annular channel for producing a substantially 180° reversal of the flow exiting said inner channel, said annular channel having an outlet which communicates with said inlet of said centrifugal pump, the improvement wherein said annular channel has a gradually increasing cross-sectional area in-the flow direction, said inlet portion and said inner channel form a U shape, and said inlet portion communicates with a suction pipe arranged above said inlet to said centrifugal pump.

2. The pump arrangement as defined in claim 1, wherein said channel means is formed as an elongated tube and is arranged such that its longitudinal axis intersects the axis of said shaft.

3. The pump arrangement as defined in claim 1, wherein said channel means is secured to said jacket means by means of sealing contact surfaces.

4. The pump arrangement as defined in claim 1, wherein said jacket means further has a substantially tubular portion and a curved portion communicating therewith, said curved portion having an outlet connected to said inlet of said centrifugal pump.

5. The pump arrangement as defined in claim 4, wherein part of said curved portion of said jacket means near said inlet of said centrifugal pump is formed integrally with said channel means.

6. The pump arrangement as defined in claim 4, wherein a part of said curved portion of said jacket means near said inlet of said centrifugal pump is formed integrally with said casing.

7. The pump arrangement as defined in claim 1, wherein said nozzle is substantially coaxial with said channel means.

8. The pump arrangement as defined in claim 7, wherein said nozzle communicates with a pressure side of said centrifugal pump by way of a pressure chamber defined by an external jacket surrounding said ejector and part of said casing.

9. The pump arrangement as defined in claim 8, wherein said channel means is further secured to said external jacket by means of a fixing projection.

10. The pump arrangement as defined in claim 8, further comprising a pressure pipe communicating with said pressure chamber, said pressure pipe and said suction pipe being rigidly connected to said external jacket.

* * * * *